United States Patent [19]

Lee

[11] Patent Number: 4,938,670

[45] Date of Patent: Jul. 3, 1990

[54] ROTARY FLUID MACHINE

[76] Inventor: Tocew Lee, P.O. Box 10160, Taipei, Taiwan

[21] Appl. No.: 416,033

[22] Filed: Oct. 2, 1989

[51] Int. Cl.[5] ..... F04C 18/18

[52] U.S. Cl. ..... 418/150; 418/206; 418/15

[58] Field of Search ..... 418/15, 150, 206

[56] References Cited

U.S. PATENT DOCUMENTS

| | | | |
|---|---|---|---|
| 3,056,355 | 10/1962 | Brun | 418/206 X |
| 3,089,638 | 5/1963 | Rose | 418/150 |
| 3,105,634 | 10/1963 | Hubrich | 418/206 |
| 3,371,856 | 3/1968 | Thelen et al. | 418/150 |
| 4,455,132 | 6/1984 | Messori | 418/206 |

FOREIGN PATENT DOCUMENTS

| | | | |
|---|---|---|---|
| 889092 | 12/1943 | France | 418/206 |

*Primary Examiner*—Michael Koczo

*Assistant Examiner*—Douglas J. Makosy

[57] ABSTRACT

A rotary fluid machine includes two intermeshing rotors rotatably mounted in a double-cylinder bore portion of a casing, each rotor having two lobe portions disposed on two opposite ends of a long coordinate axis of the rotor and having a waist portion confined by two shallow recess portions formed on two opposite sides of a short coordinate axis of the rotor so that one rotor can be smoothly rotatably engageable with the other rotor in a single-point contact for a smooth running of the two rotors. For a buffer of a higher output fluid pressure, a balancing chamber is formed between the bore portion and a fluid outlet so that a fluid suddenly increased with fluid pressure may be backflowed into the bore portion through a plurality of holes formed in a partition plate between the chamber and the bore portion for preventing water or air hammer when handling high-pressure fluid.

5 Claims, 4 Drawing Sheets

ROTARY FLUID MACHINE

BACKGROUND OF THE INVENTION

W. E. Rose disclosed two Roots type intermeshing impellers for fluid handling apparatus of the rotary positive displacement type in his U.S. Pat. No. 3,089,638. In reviewing his FIG. 1 a lobe portion 34 of the right rotor 26 intermeshing a waist portion 32 of the left rotor 25 with a large contacting area rather than a single-point contact as recited in his specification. Such a larger contacting area when the two rotors are intermeshed and intersected at a right angle between the two rotors, a great friction loss will be caused to reduce its overall output energy. The specific rotor profile of Rose prior art is formed with a deeply recessed waist area 32, thereby producing an abrupt "deflection point" such as designated as numeral **25*a*, 26*a* as shown in FIG. 7 (accompanying with thi application) which may influence a smooth rotatable engagement between the two rotors 25, 26**.

When the two rotors of Rose prior art are rotatated at 45 degrees from its ordinate or abscissa, the abrupt "deflection points" **25*a*, 26*a* of the two rotors are not smoothly engageable with each other, still possibly causing wearing of their interfaces or even vibrational shock during the running. If Rose rotors are inferentially modified to have too shallow concave waist portions 32** as shown in dotted line of FIG. 7, they are smoothly engageable, but still having a larger contacting area for causing friction loss.

Brun's U.S. Pat. No. 3,056,355 has also such an abrupt deflection point "P" between the waist portion and the outer lobe portion. So, a clearance between the rotor and the casing is provided for the smooth running of his rotors, entailing considerable loss of output due to such clearance.

Hubrich did not specify the relationship between a curvature radius of the waist recess portion and another curvature radius of the lobe portion in his U.S. Pat. No. 3,105,634. However, in view of his FIGS. 6 and 4, his waist curvature radius is about 1.3–1.6 times larger than the lobe radius. It means that the curvature radius of the rotor waist portion is still too small to provide a shallow concave waist portion so that a deeply recessed waist portion of one rotor may increase its contacting area with the other rotor when rotatably intermeshed at a right angle therebetween, thereby causing a greater friction loss and reducing its output.

The present inventor has found the drawbacks of the rotor profiles of conventional Roots type rotary fluid machines and invented the present rotary fluid machine having smoothly operating rotors.

SUMMARY OF THE INVENTION

The object of the present invention is to provide a rotary fluid machine including a pair of intermeshing rotors of identical shape which are mounted on parallel shafts and are operatively rotated in opposite directions by a pair of gears, each rotor having a shallow concave waist portion adapted for smoothly engaging an arcuate lobe portion of the other rotor for a single-point contact between the two rotors, thereby causing a very smooth rotation of the two rotors with a minimum friction loss from the interfaces of the intermeshing rotors.

DETAILED DESCRIPTION

Figure 1:
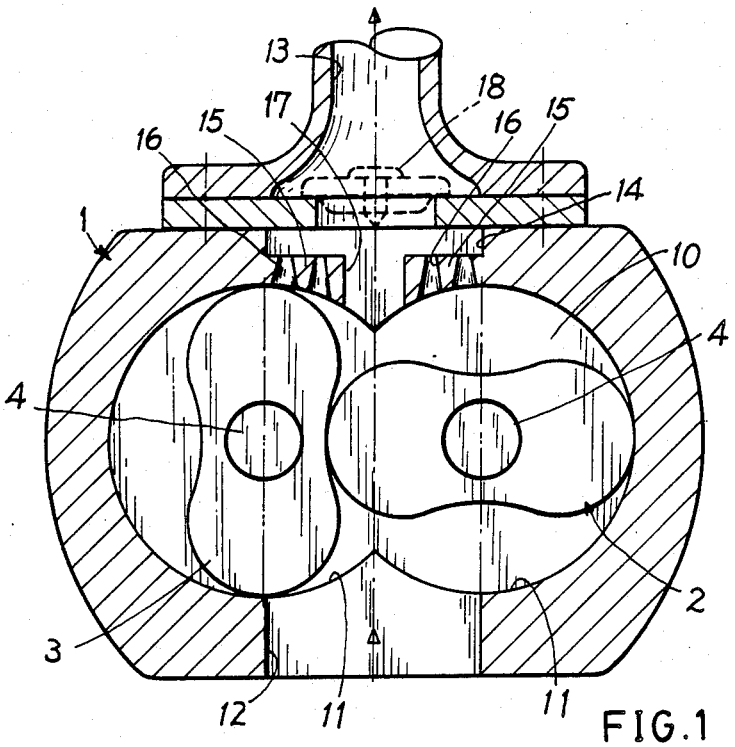
FIG. 1 is a sectional illustration of the present invention.
Figure 2:
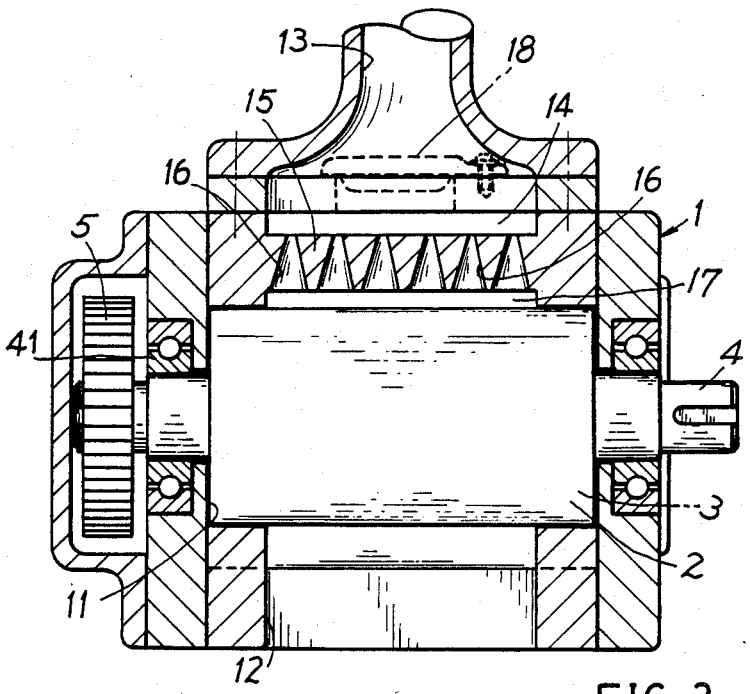
FIG. 2 is a front-view sectional illustration of the present invention.

As shown in FIGS. 1–5, a rotary fluid machine of the present invention comprises: a casing 1, and a pair of rotors 2, 3 of identical shape which are mounted on two parallel shafts 4 and are rotated in opposite directions by a pair of gears 5. A bearing 41 is provided in the casing 1 for smoothly rotatably mounting each shaft 4 in the casing 1.

The casing 1 includes: a double-cylinder bore portion 10 having two cylinders 11 intersected with each other in the casing 1 for rotatably mounting the two rotors 2, 3 in the bore portion 10, a fluid inlet 12 formed in a lower portion of the casing communicated with the bore portion 10, a fluid outlet 13 formed on an upper portion of the casing 1 fluidically communicated with the bore portion 10 through a check valve 18 formed between the outlet 13 and the bore portion 10, a pressure-balancing chamber 14 shaped as a shallow cylinder formed between the check valve 18 and a contracted discharge port 17 connected with the bore portion 10, and a partition plate 15 separating the pressure-balancing chamber 14 and the bore portion 10. A plurality of backflow holes 16 are formed in the plate 15, each hole being enlarged inwardly from the chamber 14 towards the bore portion 10. It also means that each hole 16 is tapered outwardly from the bore portion 10 towards the chamber 14. The discharge port 17 is formed in a central portion through the partition plate 15. The diameter of the pressure-balancing chamber 14 is equal or less than that of the fluid inlet 12 and the height of the chamber 14 is less than that of the discharge port 17. The diameter of the discharge port 17 is smaller than that of the inlet 12 and the chamber 14 for the increased pressure of the output fluid.

Figure 6:
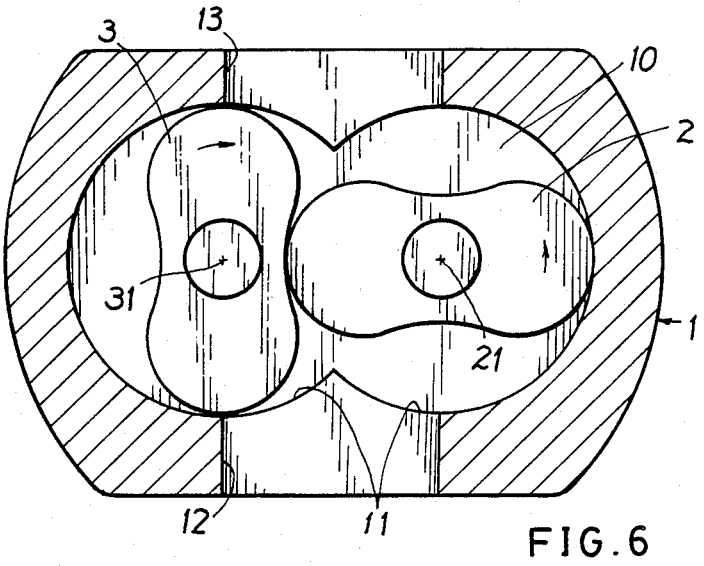
FIG. 6 shows another preferred embodiment of the present invention.
Figure 7:
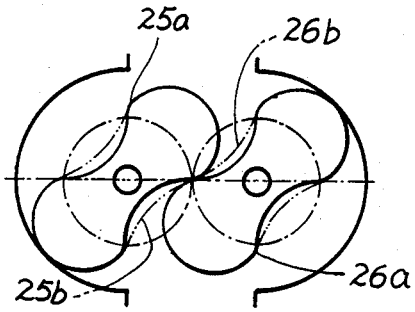
FIG. 7 PRIOR ART
FIG. 7 shows a prior art of Rose rotors.

The preferred embodiment as shown in FIG. 1 is adapted for pumping, handling or compressing fluid of which the output pressure is higher than the input pressure. However, if the present invention is used to deliver mass volume of fluid without increasing pressure, the diameter of either fluid inlet 12 or outlet 13 should then be made equal as shown in FIG. 6 which shows another preferred embodiment of the present invention.

Figure 4:
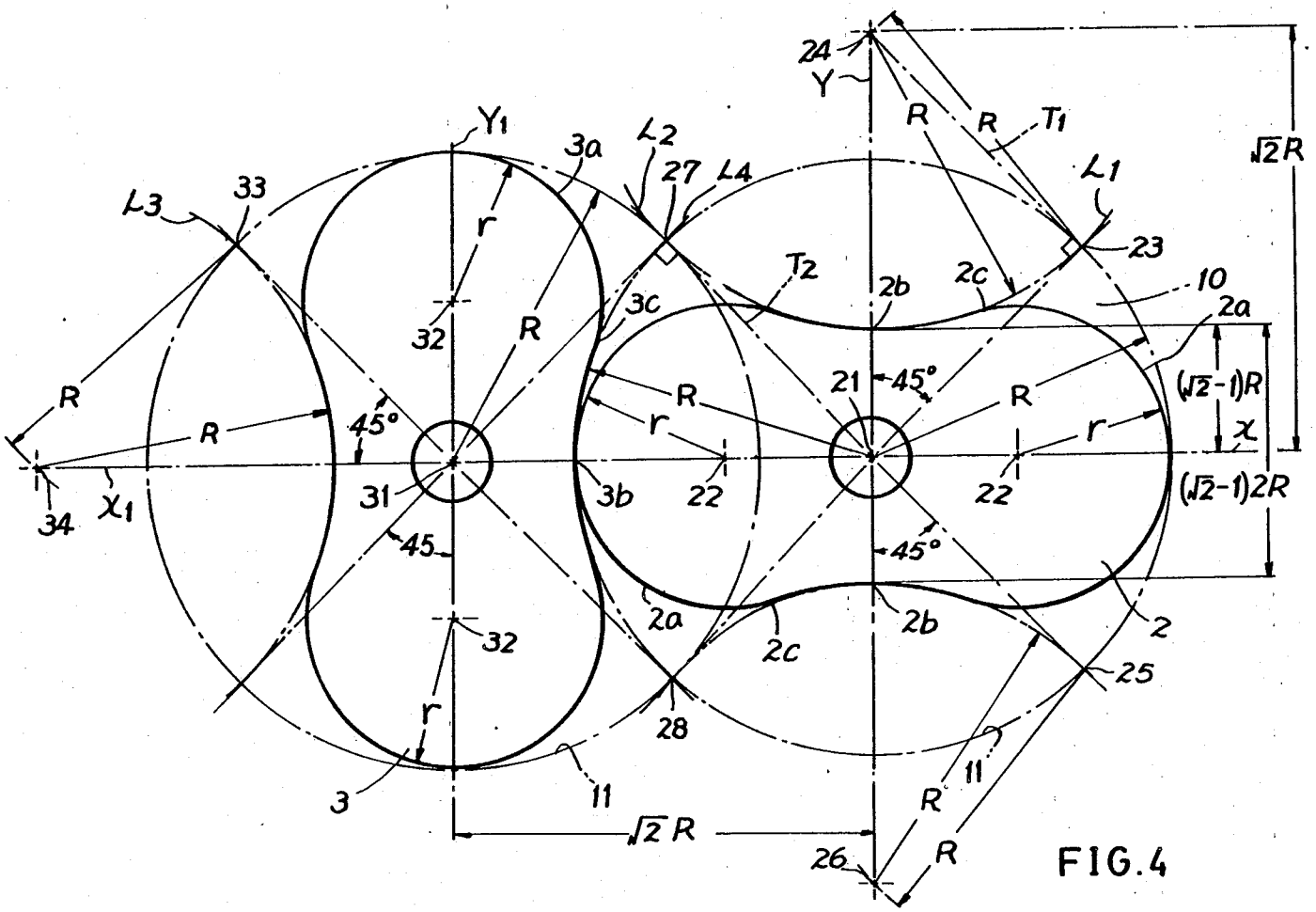
FIG. 4 is an illustration showing the way to make the two rotors of the present invention.

In making the rotors 2, 3 of the present invention, the drawing of FIG. 4 will show the steps forming the configuration or structure of the present invention.

If the radius of each rotor 2 or 3 is designated as "R" and a radius of the curvature of each lobe portion **2*a* or 3*a* of either rotor is designated as "r" which is equal to ½R. By drawing a circle around a center 21 by a radius R as shown in the right rotor 2 of FIG. 4**, a first cylinder 11 will be formed. Coordinate axes of abscissa X and ordinate Y are then plotted of which the coordinate origin is matched with the center 21 of first rotor 2. Two lobe portions 2a are then drawn, each curvature of lobe portion 2a being drawn around a center 22 aligned with the abscissa X to have its outermost end to be tangential with the cylinder wall 11. Two diagonal lines L1, L2 are drawn, each line L1 or L2 separating from either axis X or Y at 45 degrees, to intersect the circle of cylinder 11 at points 23, 25, 27, and 28. By using the same radius R and respective centers at points 23, 25, two centers 24, 26 are formed when each radius R intersects the Y axis. Then, each curvature of each shallow recess 2b disposed on both sides of the waist portion of rotor 2 is obtained by drawing each arc of radius R around the center 24 or 26 in which the arc of recess 2b is formed to smoothly intersect the two lobe portions 2a. Therefore, a rotor 2 of a smooth arcuate profile is formed by tangentially intersecting all arcs 2c each intersected between each recess 2b and each lobe portion 2a.

The other rotor 3 of the present invention is drawn on a left side of FIG. 4, in which a left abscissa X1 is plotted to be aligned with the right abscissa X and by using the same radius R, another rotor center 31 is obtained by plotting a curvature around the center point 27 to intersect the abscissa X1. The second cylinder 11 is then completed by drawing a circle of radius R around the center 31 to intersect the first (right) cylinder 11 at points 27, 28, thereby defining a double-cylinder bore portion 10 of the casing 1 for rotatably mounting the two intermeshing rotors 2, 3.

By designating the two radii r and two centers 32 aligned with a left ordinate Y1 which is perpendicular to the X1-X line, two lobe portions 3a of the left rotor 3 is finished. Two diagonal lines L3, L4 are formed at the center 31, each separated at 45 degrees from its respective axis, to intersect the circle of rotor 3 at points 33, 27. By selecting the same radii R, two centers 34, 21 are obtained by drawing two arcs around the two points 33, 27 to intersect the X1-X line respectively. Around the centers 34, 21, two curvatures are each drawn by the radius R to obtain the two shallow recesses 3b at the waist portion of the rotor 3. Each intersecting portion 3c is smoothly arcuate by tangentially intersecting each recess 3b and each lobe portion 3a. The other rotor 3 with smooth arcuate profile is also formed.

The right curvature 3b of the left rotor 3 as shown in FIG. 4 is formed by plotting an arc around a center which is sharply coincided with the center 21 of the right rotor 2. Since the diagonal lines L1, L2 are intersected with either coordinate axis X or Y at 45 degrees, the distance between point 24 and center 21 in the triangle T1 confined among points 23, 24, 21 should be equal to $\sqrt{2}$ R and the width of the rotor waist portion 2b should be $2(\sqrt{2}R-R)$ as shown in FIG. 4. Similarly, in view of a triangle T2 confined among points 27, 31, 21 intersected by two diagonal lines L2, L4 and line X-X1, the distance between the two rotor centers 31, 21 should then be $\sqrt{2}$ R.

Figure 3:
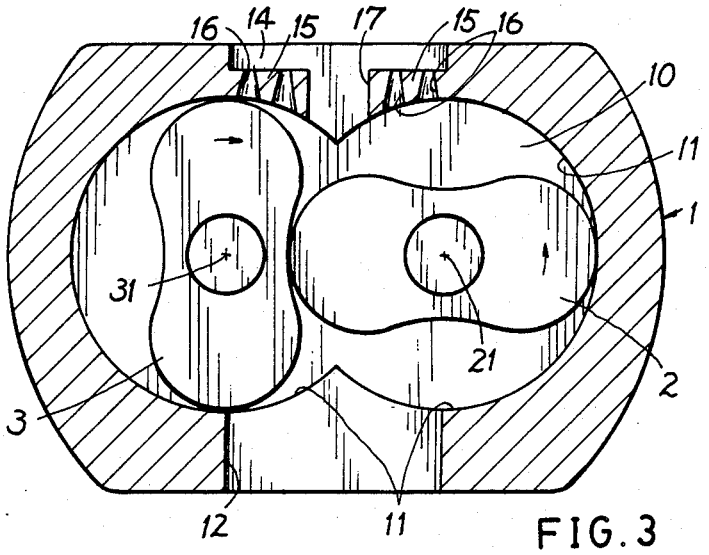
FIG. 3 is a sectional view showing the two rotors intermeshed at a right angle in accordance with the present invention.
Figure 5:
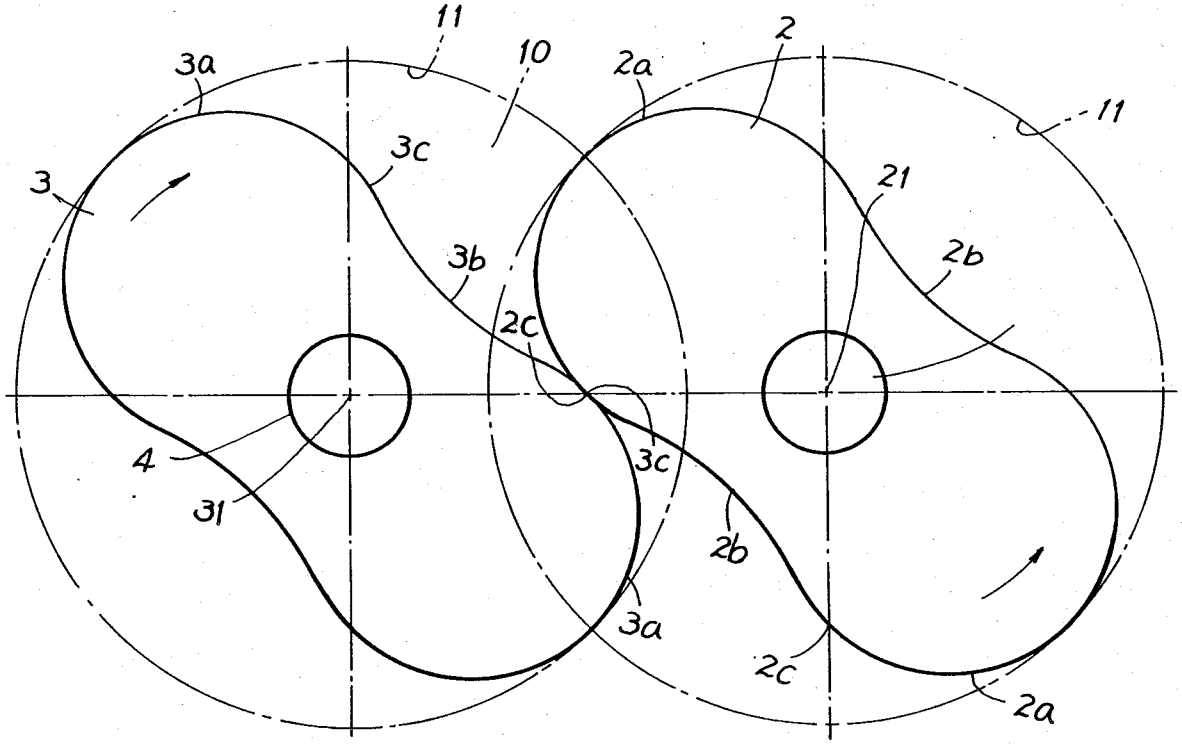
FIG. 5 shows two intermeshing rotors rotated at 45 degrees from their respective coordinate axes in accordance with the present invention.

Accordingly, the present invention discloses a rotor profile which is very smooth along its circumferential contour and the two rotors 2, 3 can be intermeshed in a single-point contact at any rotating angles. For instance, when the two rotors 2, 3 are intermeshed at a right angle as shown in FIGS. 4, 1 and 3, they are contacted at single point, thereby reducing the friction loss between the two rotors. As shown in FIG. 5, when the rotors are rotated at 45 degrees from the coordinate axes, the two rotors are still contacted at a single point. Therefore, this invention provides a smooth rotor profile which may reduce the friction loss of the rotating rotors, and prevent the rotor wearing during the intermeshing rotation.

Meanwhile, the fluid hammer such as water or air hammer caused by high pressure exerting at the output fluid may also be eliminated since a buffer for overcoming any surge of higher output pressure exerting in the pressure-balancing chamber 14 may be effected by returning the high-pressure fluid from chamber 14 through enlarged backflow holes 16 into the bore portion 10, thereby reducing or preventing such water or air hammer and prolonging the service life of the machine.

I claim:

1. A rotary fluid machine comprising:

a casing having a double-cylinder bore portion formed in said casing, a fluid inlet formed in one side of said casing communicated with said bore portion, and a fluid outlet formed in the other side of said casing opposite to said fluid inlet fluidically communicated with said bore portion through a check valve formed between said outlet and said bore portion; and a pair of intermeshing Roots type rotors respectively mounted on a pair of shafts rotatably mounted in said double-cylinder bore portion of said casing and respectively driven by a pair of gears, each said rotor having a pair of lobe portions respectively disposed on two opposite ends of a long coordinate axis of a profile of said rotor, and a waist portion formed on a central portion of said rotor having a pair of shallow recess portions formed on two opposite sides of a short coordinate axis perpendicular to said long coordinate axis of said profile of said rotor, both said axes intersected at an origin of a center of said rotor, the improvement which comprises:

each said lobe portion of said rotor having a curvature radius r of one half of a radius R of said rotor rotatably defined in each cylinder of said double-cylinder bore portion of said casing, said cylinder of said double-cylinder bore portion having the same radius R of said rotor, each said shallow recess portion of said waist portion having a curvature radius R as same as the radius R of said rotor, of which each said recess portion is obtained by plotting an arc with the radius R around a curvature center on a line extrapolated from said short coordinate axis of said rotor, and said curvature center for plotting said recess portion having a distance of $\sqrt{2}$ R separated from center of said rotor and also said center of said cylinder of said double-cylinder bore portion, said waist portion having a transverse thickness of $2R(\sqrt{2}-1)$, a distance between two said centers of two said cylinders or between two centers of two said rotors intermeshed and rotatably mounted in said double-cylinder bore portion being $\sqrt{2}$ R, whereby upon a tangential intersecting between each said shallow recess portion and each said lobe portion, a smooth rotor profile will be formed for ensuring a single-point contact between the two intermeshing rotors for a smooth running of said rotors.

2. A rotary fluid machine according to claim 1, wherein said casing of said fluid machine further includes a pressure-balancing chamber in between said check valve of said fluid outlet and said double-cylinder bore portion, said pressure-balancing chamber separated from said bore portion by a partition plate having a plurality of backflow holes formed through said partition plate, and a fluid discharge port formed in a central portion of said partition plate communicating said bore portion and said pressure-balancing chamber.

3. A rotary fluid machine according to claim 2, wherein each said backflow hole is enlarged from said chamber towards said bore portion.

4. A rotary fluid machine according to claim 2, wherein said pressure-balancing chamber is generally shaped as a cylinder having a diameter equal or smaller than a diameter of said fluid inlet, and having a height smaller than a length of said discharge port.

5. A rotary fluid machine according to claim 2, wherein said fluid discharge port has a diameter smaller than the diameter of said fluid inlet.

* * * * *